United States Patent [19]

Serfess

[11] 4,067,280

[45] Jan. 10, 1978

[54] SAILBOAT CONTROL APPARATUS

[76] Inventor: Albert Serfess, 123 Bank St., Grass Valley, Calif. 95945

[21] Appl. No.: 711,133

[22] Filed: Aug. 3, 1976

[51] Int. Cl.[2] ..... B63B 41/00

[52] U.S. Cl. ..... 114/128; 114/102

[58] Field of Search ..... 114/39, 102, 127, 128, 114/130, 132, 136, 140, 141, 143, 144 R

[56] References Cited

U.S. PATENT DOCUMENTS

| | | | |
|---|---|---|---|
| 2,402,724 | 6/1946 | Bidwell | 114/144 R |
| 2,573,745 | 11/1951 | Wallenberg | 114/39 |
| 3,259,093 | 7/1966 | Taylor | 114/39 |
| 3,274,849 | 9/1966 | Hanson | 114/144 R |
| 3,641,962 | 2/1972 | Fowlkes et al. | 114/144 R |
| 3,839,978 | 10/1974 | Hendrickson | 114/39 |

FOREIGN PATENT DOCUMENTS

| | | | |
|---|---|---|---|
| 293,226 | 7/1916 | Germany | 114/39 |
| 26,800 | 10/1897 | United Kingdom | 114/130 |

*Primary Examiner*—George E. A. Halvosa
*Assistant Examiner*—Stuart M. Goldstein
*Attorney, Agent, or Firm*—Robert D. Farkas

[57] ABSTRACT

This disclosure pertains to a pivotable control mechanism affecting the angular position of a centerboard as a function of the position of the boom of the mainsail. A pivot arm extending radially outwardly from the pivot axis of an extended pivotable centerboard is fastened flexibly and adjustably to the mainsail boom at a point aft of the mainmast. The trailing edge of the centerboard is pivoted outboard in a direction opposite to the trailing edge of the boom, providing thereby automatic compensation for the wind on the sail by allowing a variable pressure to be created on the centerboard therefor.

1 Claim, 3 Drawing Figures

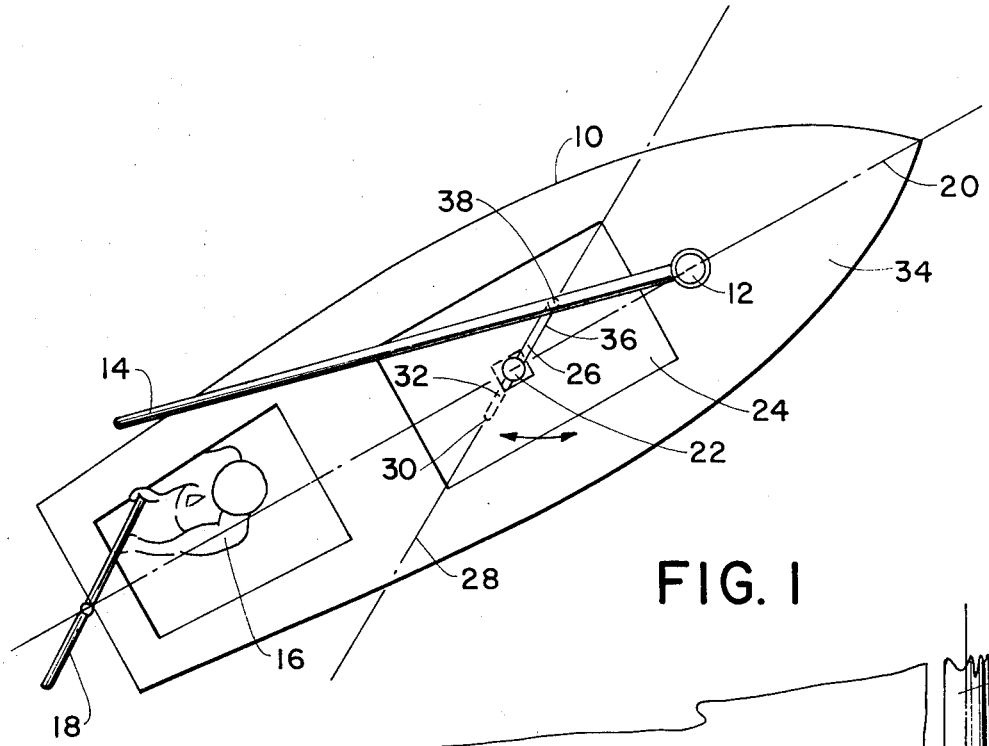
FIG. 1
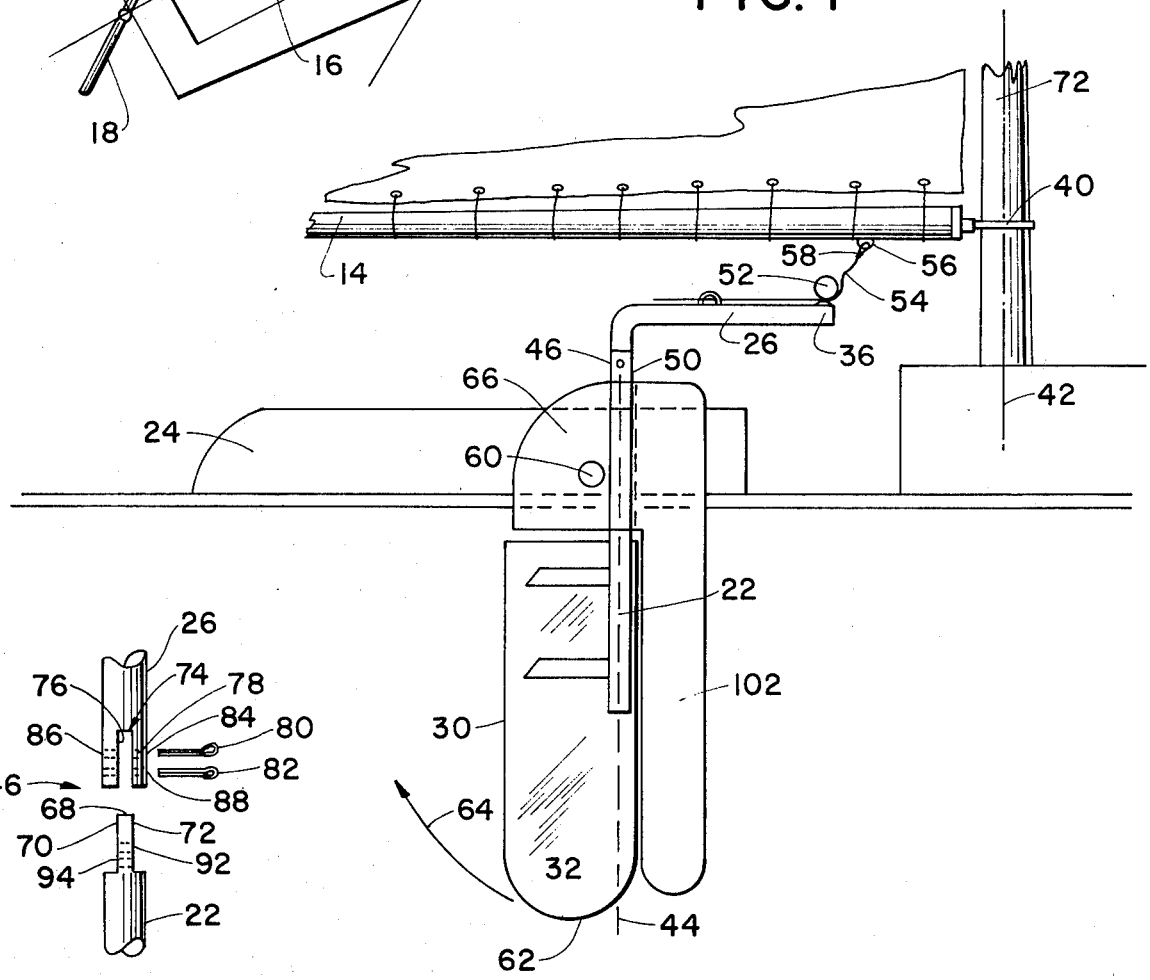
FIG. 3
FIG. 2

SAILBOAT CONTROL APPARATUS

BACKGROUND OF THE INVENTION

1. Field of the Invention

This invention relates to sailing vessels and more particularly to that class utilizing control devices to automatically pivot a centerboard upon the angular diplacement of the mainsail boom away from the centerline of the craft.

2. Decription of the Prior Art

The prior art abounds with centerborad control devices. U.S. Pat. No. 61,049 issued on Jan. 8, 1867 to R. Chambers teaches a pair of angularly displaced centerboards each positioned exclusive of the other when the vessel is careened over by the force of the wind so as to place the lowered centerboard in a position substantially normal to the surface of the water. U.S. Pat. No. 2,653,563 issued on Sept. 29, 1953 to W. Long teaches a rudder linkage device to couple the vertical plane occupied by the rudder to the angular position of the boom of the mainmast so that the rudder is always maintained in a vertical plane relative to the surface of the water independent of the hull position so that the rudder will not create an excessive drag. U.S. Pat. No. 3,370,560 issued on Feb. 27, 1968 to F.M. Lucht discloses, in part, a centrally located rudder or centerboard device which may be manually rotated, for steering purposes whilst being maintained in a substantially vertical plane when the catamaran type vessel, disclosed therein, rolls from side to side. U.S. Pat. No. 2,608,173 issued on Aug. 26, 1952 to H.H. Kersten teaches a centerboard whose cross-sectional shape may be altered to dynamically represent a curved air foil, similarly to that of an aircraft wing so as to control the angle of incidence of the board and the degree of flexation thereof, tending to counterbalance the drift tendencies of the hull. All of the aforementioned patents suffer the common deficiency of failing to automatically cause the centerboard to pivot about a line substantially parallel to the mainmast when the boom, pivotably affixed thereto, swings from side to side due to the forces of the wind.

SUMMARY OF THE INVENTION

A primary object of the present invention is to provide a pivotable centerboard or keelboard, which automatically and controllably pivots about an essentially vertical line in a direction opposite to the angular displacement of the main sail boom aft of the mainmast of a sailing vessel.

Another object is to provide a variable coupling linkage arrangment between a centerboard pivoting arm and the boom, enabling a variable amount of torque to be exerted on the centerboard pivoting shaft.

Still another object is to provide a variable coupling linkage arrangement which enables the boom to change its height position along the mainmast length whilst effectively coupling the angular position of the boom to the centerboard pivoting arm.

Yet another object is to provide an inexpensive detachable apparatus which can be fitted to existing centerboards so as to accomplish the objects and purposes of the instant invention.

Sailing vessels are oft times equipped with retractable centerboards which are most times stored in a centerboard well fastened to the hull of the sailing vessel. Such centerboards are permitted to be selectively lowered below the surface of the hull and extend in a plane running along the centerline of a vessel, forward and aft. It is desirous to alter the plane, occupied by the centerboard so as to automatically compensate for the angular position assumed by the boom relative to the centerline so as to cause the trailing edges of the boom and the centerboard to automatically diverge.

The instant invention accomplishes these ends by utilizing a centerboard that may have a portion thereof pivoted about a line running parallel to the longitudinal axis of the mainmast. A detachable centerboard pivot arm extends radially outwardly from the line, having the free end thereof located substantially forward of the line, flexibly coupled to the boom at a point aft of the pivotable connection of the boom to the mainmast. The trailing edge of the centerboard lies in a plane containing the line and the centerboard pivot arm at a point aft from the line and the pivot arm. A flexible line, whose length may be varied, couples the free end of the pivot arm to the boom. Upon the removal of the pivot arm, the centerboard may be stored in the well in conventional fashion.

These objects, as well as other objects of the present invention, will become more readily apparent after reading the following description of the accompanying drawings.

BRIEF DESCRIPTION OF THE DRAWINGS

FIG. 1 is a plan view of a sailing vessel equipped with the instant invention;

FIG. 2 is a side elevation view of a portion of the vessel depicted in FIG. 1; and FIG. 3 is a rear elevation view of a portion of the instant invention including the centerboard pivot arm and the centerboard pivot axle.

DESCRIPTION OF THE PREFERRED EMBODIMENT

The structure and method of fabrication of the present invention is applicable to a portion of a centerboard fixedly secured to a centerboard pivot axle. The trailing edge of the centerboard lies generally astern of the centerboard axle and aft of the non-pivotable leading edge of the board. The longitudinal axis of the centerboard pivot axle is maintained in a plane running along the fore and aft centerline of the vessel and including the longitudinal axis of the mainmast. The centerboard pivot axle is in turn pivoted about an athwart ship pivot line extending normal to the fore and aft centerline of the craft. When the centerboard is extended below the hull of the craft to the maximum possible extent, the longitudinal axis of the centerboard pivot axle lies along a line parallel to the longitudinal axis of the mainmast, along the fore and aft centerline and located astern of the mainmast. The uppermost end of the centerboard pivot axle is equipped with a tongue element whose co-planar sides are parallel to the plane of the centerboard. A centerboard pivot arm is adapted to join the tongue element by the inclusion of a notch at one free end thereof. A pin, passing through a pair of holes in adjacent faces forming the notch, and a hole in the tongue, pivotably join the pivot arm to the pivot axis. If it is desired to maintain the longitudinal axis of the pivot arm at a fixed angular relationship with the longitudinal axis of the centerboard pivot axle, an additional pin, with additional related holes, may be provided.

A portion of the centerboard pivot arm is provided with a longitudinal axis that extends radially outwardly from the centerboard pivot axle. The free end of the centerboard pivot arm, extending in the forward direction, is fitted with a quick release cleat, adapted to grasp varying portions of a flexible line thereat. One end of the flexible line is fitted with a snap type termination for engagement with a snap ring secured to the lowermost surface of the boom aft of the mainmast.

As the boom turns, to either port or starboard, the trailing edge of the lowered centerboard turns to starboard or port respectively. The tension on the flexible line determines the angular displacement of the centerboard for any angular displacement achieved by the boom. Further, slack in the flexible line enables the boom to achieve an elevated position above the deck of the craft due to the curvature of the mainsail and the force of the wind, generally exerting an upward lifting force to the boom.

Now referring to the Figures, and more particularly to the embodiment illustrated in FIG. 1 showing a sailing craft 10 equipped with a mainmast 12 and a boom 14. An operator 16, is shown manually operating rudder 18 at an angle to the centerline 20 of the craft, shown in dotted lines. Centerboard pivot axle 22 is shown extending above centerboard well 24. Centerboard pivot arm 26 is illustrated lying in a plane depicted by dotted lines 28. The trailing edge 30 of centerboard 32 is shown residing along dotted lines 28, as well as the longitudinal axes of centerboard pivot axle 22 and centerboard pivot arm 26. Boom 14 extends along dotted line 34. The free end 36 of pivot arm 26 is linked to boom 14 at point 38, causing dotted lines 28 to assume an angular relationship with dotted line 20, diverse to the angular relationship formed by dotted lines 34 with dotted lines 20.

FIG. 2 illustrates boom 14 pivotably secured at point 40 to mainmast 12. Dotted lines 42 represent the longitudinal axis of mainmast 12. Dotted lines 44 represent the longitudinal axis of pivot axle 22, to which is fixedly secured secured centerboard 32. Pivot arm 26 is removably secured to the uppermost end 50 of centerboard pivot axle 22 at point 46 utilizing pins 80 and 82 therefor. Pivot arm 26 has a free end 36 fitted with a quick release cleat 52. Flexible line 54 passes through the quick release cleat and connects to boom 14 utilizing snap ring 56 and snap fitting 58 therefor.

Centerboard well 24 houses pivotable centerboard 32 and non-pivotable centerboard portion 102 when pivot arm 26 is decoupled from centerboard pivot axle 22, at point 46, and when the centerboard pivot axle 22 and the centerboards are pivoted about athwart ship centerboard pivot axle 60. The bottommost surface 62 of centerboard 32 moves upwardly and rearwardly in the direction of arrow 64 when the centerboards are to be stored within centerboard well 24.

Athwart ship centerboard pivot axle 60 is pivotably secured to the centerboard journal plate 66. Centerboard pivot axle 22 is journaled within journal plate 66, enabling centerboard 32 to assume a planar relationship diverse to the fixed planar relationship maintained by journal plate 66.

FIG. 3 shows the uppermost end of centerboard pivot axle 22 adapted with tongue 68. Tongue sides 70 and 72 are co-planar and extend parallel to the plane formed by the sides of centerboard 32, shown in FIG. 2. The rearwardmost portion of pivot arm 26 is adapted with a notch 74 intended for engagement with tongue 68. The internal faces 76 and 78 of notch 74 are co-planar and extend substantially parallel to a plane containing the longitudinal axis 44, as shown in FIG. 2, and the free end 36 of the pivot arm 26, as shown in FIG. 2. Removable pins 80 and 82, pasing through holes 84 and 86, and holes 88 and 90, also engage holes 92 and 94, thereby removably securing the rearmost end of pivot arm 26 to the uppermost end of pivot axle 22 at point 46.

One of the advantages is to provide a pivotably centerboard or keelboard, which automatically and controllably pivots about an essentially vertical line in a direction opposite to the angular displacement of the main sail boom aft of the mainmast of a sailing vessel.

Another advantage is to provide a variable coupling linkage arrangement between a centerboard pivoting arm and the boom, enabling a variable amount of torque to be exerted on the centerboard pivoting shaft.

Still another advantage is to provide a variable coupling linkage arrangement which enables the boom to change its height position along the mainmast length whilst effectively coupling the angular position of the boom to the centerboard pivoting arm.

Yet another advantage is to provide an inexpensive detachable apparatus which can be fitted to existing centerboards so as to accomplish the objects and purposes of the instant invention.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appended claims.

I claim:

1. In a sailing vessel, a centerboard, a mainmast, a mainsail boom, said mainsail boom extending radially outwardly from said mainmast and aftermost therefrom, the improvement comprising a centerboard pivot means for pivotably rotating said centerboard about a line, said line extending substantially parallel to the longitudinal axis of said mainmast, said line being disposed along the fore and aft centerline of said sailing vessel and aft of said longitudinal axis of said mainmast, linkage means for pivotably linking the angular position of the trailing edge of said centerboard to said mainsail boom, said trailing edge being disposed in an outboard direction opposite to the outboard direction assumed at a sternmost point of said mainsail boom when said mainsail boom is skew to said fore and aft centerline of said sailing vessel, said linkage means including a flexible adjustable linkage element between said centerboard and said mainsail boom for adjusting said angular position and for permitting said mainsail boom to assume diverse positions along the height of said mainmast, said centerboard pivot means including a centerboard pivot axle and a centerboard pivot arm and disengagable joining means for selectively connecting one end of said pivot arm to the uppermost end of said centerboard pivot axle, a flexible line element, the other end of said pivot arm releasably engaged to a point along the length of said flexible line element, one end of said flexible line element being disposed in releasable engagement with said mainsail boom at a joining point intermediate said mainmast and said stermost point, said joining point being substantially intermediate said longitudinal axis of said mainmast and said line when said mainsail boom extends along said fore and aft centerline, a quick release cleat, a snap ring, a snap, said other end of said pivot arm being fixedly secured to said quick release cleat, a portion of the length of said flexible line element releasably engaged with said quick release cleat, one end of said flexible line element fixedly secured to said snap, said snap being removably engaged with said snap ring, said snap ring being fixedly secured to said mainsail boom at said joining point.

* * * * *